United States Patent [19]

Putney

[11] Patent Number: 5,011,324

[45] Date of Patent: Apr. 30, 1991

[54] DETENT STRUCTURE HAVING A RETAINING LIP WITH A SMOOTH CONTINUOUS OUTER SURFACE FREE FROM STRESS-CONCENTRATING CORNERS

[75] Inventor: Gordon A. Putney, Lake Geneva, Wis.

[73] Assignee: Snap-on Tools Corporation, Kenosha, Wis.

[21] Appl. No.: 522,902

[22] Filed: May 14, 1990

[51] Int. Cl.[5] ..... B25G 3/18; F16B 21/07

[52] U.S. Cl. ..... 403/328; 29/441.1

[58] Field of Search ..... 403/328, DIG. 6; 29/441.1, 439, 441.2, 808

[56] References Cited

U.S. PATENT DOCUMENTS

| | | | |
|---|---|---|---|
| 1,334,154 | 3/1920 | Harrison | 403/328 |
| 1,798,738 | 3/1931 | Hoern | 403/122 |
| 2,103,040 | 12/1935 | Radcliffe | 403/328 |
| 2,216,878 | 10/1940 | Densmore | 29/441.1 |
| 2,474,360 | 8/1945 | Jimerson | 403/328 |
| 3,253,330 | 5/1966 | Davies | 29/441.1 |
| 3,609,853 | 10/1971 | Davies et al. | 29/441.1 |
| 3,670,374 | 6/1972 | Hayes, Jr. | 29/281.1 |
| 3,707,303 | 12/1972 | Petri | 403/328 |
| 3,722,078 | 3/1973 | Cupler, II | 29/557 |
| 4,615,191 | 10/1986 | Grandy | 403/328 |
| 4,747,203 | 5/1988 | Yukita et al. | 29/439 |

FOREIGN PATENT DOCUMENTS

| | | | |
|---|---|---|---|
| 923757 | 9/1956 | Fed. Rep. of Germany | 403/328 |

*Primary Examiner*—P. W. Echols
*Assistant Examiner*—David P. Bryant
*Attorney, Agent, or Firm*—Emrich & Dithmar

[57] ABSTRACT

A detent ball is retained in a recess against a bias spring by deforming the material around the open end of the recess radially and axially inwardly of the recess to define a retaining lip to hold the ball in place, the lip having a substantially part-spherical outer surface. The deformation is accomplished by an embossing tool having a part-spherical embossing surface which converges from an end wider than the recess to an end narrower than the recess. A part-spherical cavity in the end of the embossing tool accommodates the ball during the deformation process.

8 Claims, 2 Drawing Sheets

DETENT STRUCTURE HAVING A RETAINING LIP WITH A SMOOTH CONTINUOUS OUTER SURFACE FREE FROM STRESS-CONCENTRATING CORNERS

BACKGROUND OF INVENTION

1. Field of the Invention

The present invention relates to detent structure of the type which captures a detent member against a bias spring in a recess. The invention also relates to a method and apparatus for forming the detent structure by deforming material around the open end of the recess to define a retaining lip.

2. Description of the Prior Art

It is known to retain a detent member, such as a detent ball, in a recess against a bias spring by means of deforming the material around the outer end of the recess inwardly to form a retaining lip which captures the detent ball in the recess. Typically this has been accomplished by the use of an embossing tool which is driven axially into the recess, the tool typically having a flat annular embossing surface which extends around the open end of the recess and pushes the material around the open end of the recess downwardly, displacing it radially inwardly to form the retaining lip. Such detents are typically used in tools such as drive squares for sockets, as in ratchet wrenches and the like.

It has been found that the detent-retaining lip or emboss formed by such prior art embossing techniques has been the source of a relativly high percentage of failures in tools such as drive squares and the like, in that cracks have tended to originate in the retaining lip. It is theorized that this is because of the particular concentration of stress forces in the retaining lip caused by the embossing process and, in particular, by the shape of the embossing tool.

SUMMARY OF THE INVENTION

It is a general object of the present invention to provide an improved detent structure comprising a detent member captured in a recess, as well as an improved method for forming such a detent structure and a tool for performing that method, all of which avoid the disadvantages of prior techniques while affording additional structural and operating advantages.

An important feature of the invention is the provision of a method for capturing a detent member in a recess which is relatively simple and economical and reduces the failure rate in the resulting product.

In connection with the foregoing feature, another feature of the invention is the provision of a method of the type set forth, which results in the formation of a detent-retaining lip which has a stress pattern which is less susceptible to crack formation.

It is another feature of the invention to provide an improved embossing tool for performing the method.

In connection with the foregoing feature, it is still another feature of the invention to provide an embossing tool which has a sloping and non-concave embossing surface.

Still another feature of the invention is the provision of a detent structure formed by the method of the type set forth, which results in an embossed surface substantially free of concave corners.

Certain ones of these features of the invention are attained by providing detent structure comprising: a body having an outer surface with a recess formed therein, a detent member disposed in the recess, and a retaining lip formed around the perimeter of the recess at the open end thereof and projecting laterally inwardly thereof, the retaining lip having an inner surface engageable with the detent member for preventing escape of the detent member from the recess, the retaining lip having a smooth continuous outer surface free of corners and extending from the outer surface of the body substantially to the lateral inner end of the retaining lip.

Others of these features of the invention are attained by providing a method for capturing a detent member in a recess formed in the outer surface of a body and having an open end, the method comprising the steps of: providing an embossing tool formed of a material harder than that of the body and having a smooth, continuous, external embossing surface, the embossing surface being convergent toward an axis and having a cross-sectional shape transverse to the axis which corresponds to the shape of the open end of the recess, the embossing surface extending from a wide end having a perimeter greater than that of the open end of the recess to a narrow end having a perimeter less than that of the open end of the recess; and driving the embossing surface against the outer surface of the body coaxially with the open end of the recess to deform the body around the circumference of the open end of the recess for displacing body material axially and radially inwardly of the recess to define a retaining lip dimensioned to retain the detent member in the recess.

Still others of these features are attained by providing an embossing tool for use in deforming a body around the open end of a recess in the outer surface of the body to form a lip for capturing a detent member in the recess, the tool comprising: an embossing head formed of a material harder than that of the body; and a smooth, continuous, external embossing surface on the head convergent toward an axis and having a cross-sectional shape transverse to the axis which corresponds to the shape of the open end of the recess, the embossing surface extending from a wide end having a perimeter greater than that of the open end of the recess to a narrow end having a perimeter less than that of the open end of the recess.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 4:
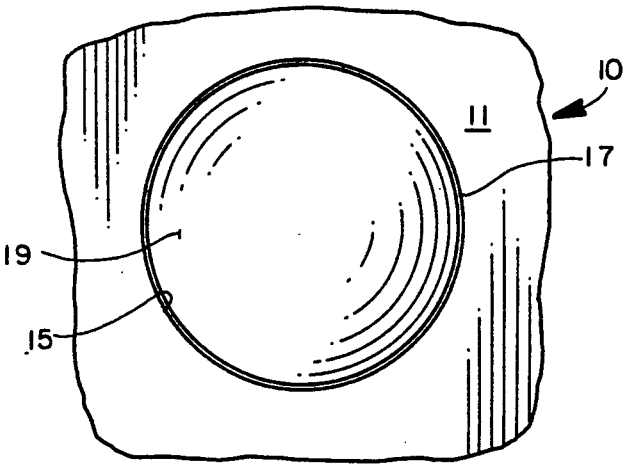
FIG. 4 is an enlarged, fragmentary, top plan view of the outer surface of a drive square body and a detent ball aligned with a recess in the body.
Figure 5:
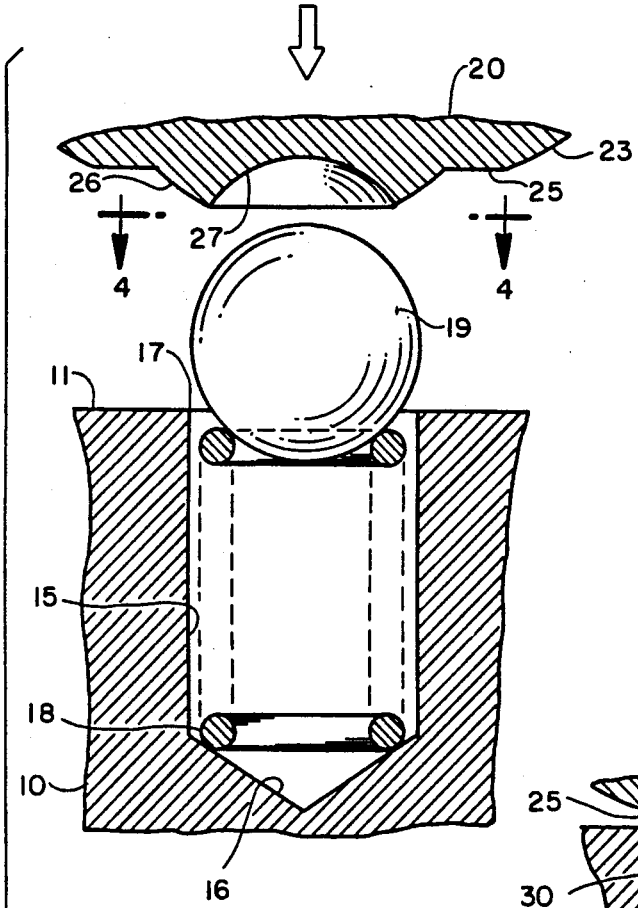
FIG. 5 is a reduced, fragmentary view in diametrical vertical section of the detent ball and recess of FIG. 4, and illustrating the embossing tool of the present invention as it is moved into position above the ball and recess.

Referring to FIGS. 4 and 5, there is illustrated a body 10 which may, for example, be a drive square for a socket wrench set or the like. The body 10 has an outer surface 11 in which is formed a circularly cylindrical recess 15 having a frustoconical inner end 16 and a circular outer end 17. Disposed in the recess 15 is a helical compression spring 18 on which is seated a detent ball 19 having a diameter very slightly less than the diameter of the recess 15 for free movement therein.

Figure 1:
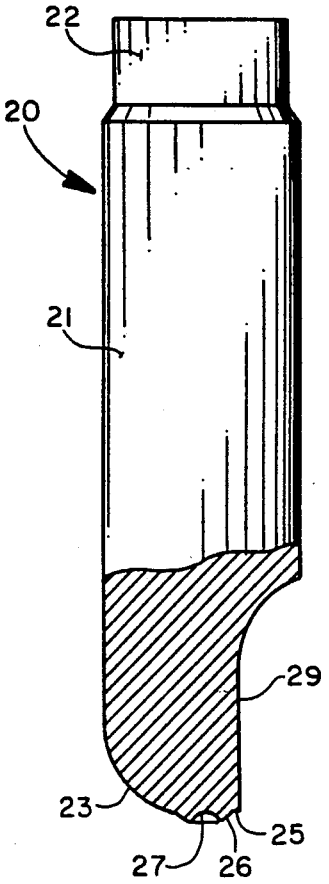
FIG. 1 is a side elevational view, in partial section, illustrating an embossing tool constructed in accordance with and embodying the features of the present invention.
Figure 2:
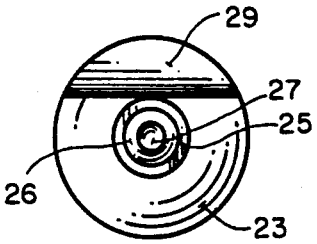
FIG. 2 is an end elevation veiw, rotated 90° counterclockwise, of the lower end of the embossing tool of FIG. 1.
Figure 3:
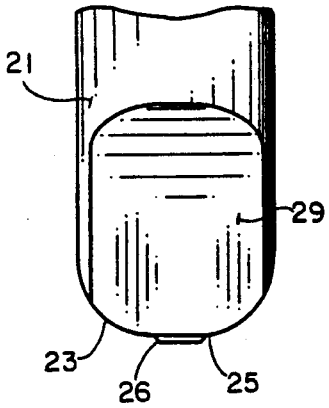
FIG. 3 is a fragmentary side elevational view of the lower end of the embossing tool of FIG. 1, as viewed from the righthand side thereof.

Referring to FIGS. 1-3, there is illustrated an embossing tool 20, constructed in accordance with and embodying the features of the present invention. The tool 20 includes an elongated cylindrical shank 21 having a reduced end 22 adapted to be fitted into an associated appliance, such as a suitable holder or drive mechanism. The other end of the shank 21 has a rounded portion 23 which terminates at a flat, annular surface 25, from the inner edge of which depends a part-spherical embossing surface 26. The embossing surface 26 is inclined downwardly and inwardly toward the axis of the shank 21, converging from a wide end, at the junction with the annular surface 25, which has a diameter greater than that of the open end 17 of the recess 15, to a narrow end having a diameter less than that of the open end 17 of the recess 15. Formed in the distal end of the shank 21 coaxially with the embossing surface 26 is a part-spherical, concave cavity 27, which has a radius substantially the same as the ball 19 and which intersects the embossing surface 26 around the entire perimeter of the narrow end thereof. The shank 21 has a side recess 29 formed in one side thereof above the annular surface 25 for purposes of clearance of associated structure during use of the embossing tool 20 in the embossing process.

Figure 6:
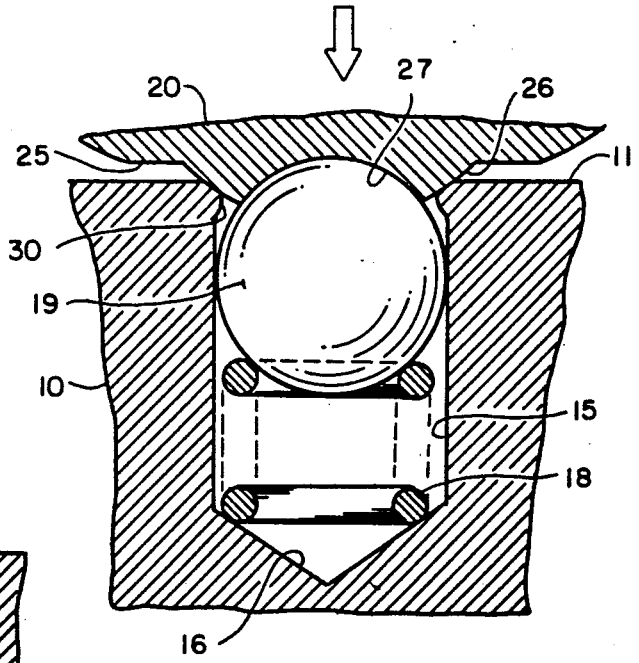
FIG. 6 is a view similar to FIG. 5, and illustrating the embossing tool in engagement with the drive square body at completion of the embossing operation.
Figure 7:
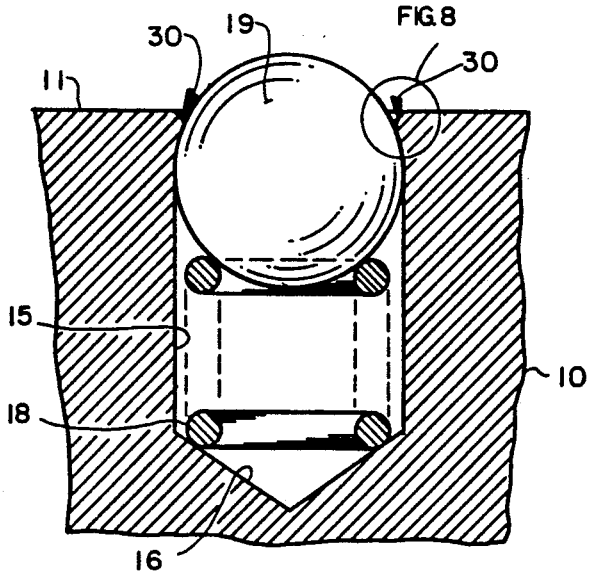
FIG. 7 is a view similar to FIG. 6, illustrating the finished drive square product after removal of the embossing tool.

The use of the embossing tool 20 is illustrated in FIGS. 5-7. The embossing tool 20 is lowered over the recess 15 coaxially therewith, as illustrated in FIG. 5, and is then driven coaxially into the recess 15 in the direction of the arrow. The embossing surface 26 engages the body 10 around the open end 17 of the recess 15, the ball 19 being accommodated in the cavity 27. The embossing tool 20 is formed of a material which is hardser than that of the drive body 10. Thus, as the embossing tool 20 continues to be driven into the recess 15, the embossing surface 26 deforms the material of the body 10 around the entire perimeter of the open end 17 of the recess 15, displacing the material radially and axially inwardly of the recess 15. This embossing operation continues until embossing surface 26 has been driven into the recess 15 to a predetermined depth, which may be determined by trail. This predetermined embossing depth, illustrated in FIG. 6, is sufficient to deform the material into a retaining lip 30 which has an inner diameter substantially less than that of the ball 19, so as to capture the ball 19 in the recess 15.

At this point, the embossing tool 20 is removed and the ball 19 moves back out against the retaining lip 30 under the urging of the spring 18, as illustrated in FIG. 7. Preferably, the embossing operation is set to accomplish a sufficient deformation of the retaining lip 30, so that in the finished product, the ball 19 will project from the recess 15 beyond the outer surface 11 an amount sufficient to effectively perform its detent function.

Figure 8:
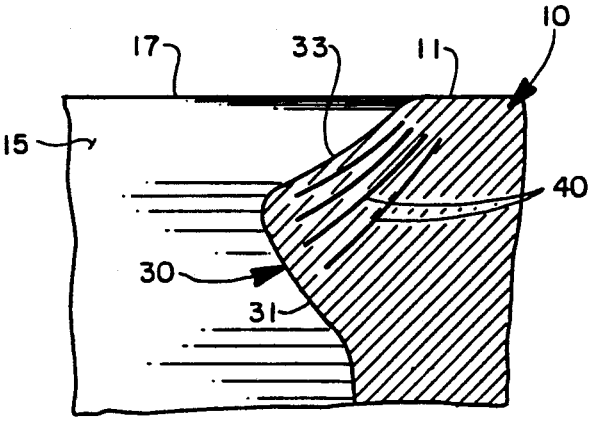
FIG. 8 is an enlarged, fragmentary view of a portion of the retaining lip illustrated in FIG. 7.

Referring to FIG. 8, it can be seen that the retaining lip 30 has a lower bearing surface 31 which engages the ball 19 and an outer surface 33 which is depressed axially inwardly of the recess 15 with respect to the outer surface 11, the surface 33 being substantially part-spherical in shape, generally conforming to the shape of the embossing surface 26 which formed it. Because the outer surface 33 is a gently sloping, continuous surface, with no pronounced corners, the embossing process generates flow lines 40, representing regions of stress concentration as a result of deformation, which are relatively dispersed. It has been found that this configuration is much less susceptible to initiating cracks than the prior art arrangement.

The deformation of the material of the body 10 by the embossing tool 20 results in the creation of residual compressive stresses which are retained in the material of the body 10 after the embossing tool 20 has been removed. It has been found that the pattern of residual compressive stresses which results from the present invention further serves to minimize the initiation of cracks as a result of external stresses applied to the retaining lip 30 in subsequent use.

Figure 9:
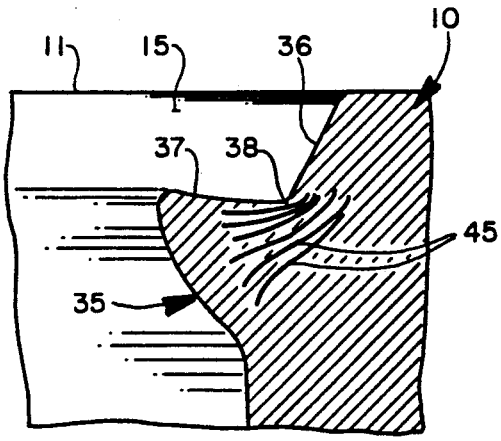
FIG.9 (PRIOR ART)
FIG. 9 is a view similar to FIG. 8, illustrating a retaining lip formed by a prior art embossing tool.

Referring to FIG. 9, there is illustrated a retaining lip 35 formed by a prior art embossing tool, which typically has a relatively flat embossing surface. The embossing operation performed with such a tool results in a retaining lip 35 which is defined by an upper outer surface 36 which slopes sharply downwardly and is joined to a generally horizontal lower outer surface 37 by a relatively sharp or pronounced concave corner or vertex 38. This sharp corner results in very concentrated pattern of flow lines 45, which has tended to induce cracking in the prior art detent structure. Furthermore, the pattern of residual compressive stresses induced in the body by this prior art embossing technique was more susceptible to the initiation of cracks than that resulting from the present invention.

From the foregoing, it can be seen that there has been provided an improved embossing tool, embossing technique performed thereby and detent structure formed thereby for capturing a detent member in a recess in a body, by deforming the body material in such a way as to effectively trap the detent member while substantially reducing the tendency to failure in the deformed material.

I claim:

1. Detent structure comprising: a body having an outer surface with a recess formed therein, a detent member disposed in said recess, and a retaining lip formed around the perimeter of said recess at the open end thereof and projecting laterally inwardly thereof, said retaining lip having an inner surface engageable with said detent member for preventing escape of said detent member from said recess, said retaining lip having a smooth continuous outer surface free of corners and extending from said outer surface of said body substantially to the lateral inner end of said retaining lip, said outer surface of said retaining lip being depressed axially inwardly of said recess with respect to said outer surface of said body.

2. The detent structure of claim 1, wherein said recess is substantially circularly cylindrical.

3. The detent structure of claim 2, wherein said outer surface of said retaining lip is circular in cross section transverse to the axis of said recess.

4. The detent structure of claim 3, wherein said outer surface of said retaining lip is substantially partspherical.

5. The detent structure of claim 1, and further comprising bias means disposed in said recess beneath said detent member for resiliently urging said detent member against said retaining lip.

6. The detent structure of claim 1, wherein said detent member is a ball.

7. The detent structure of claim 1, wherein said outer surface of said retaining lip is concave.

8. The detent structure of claim 1, wherein said inner surface is convex.

* * * * *